United States Patent [19]

Hubert

[11] Patent Number: 4,686,721

[45] Date of Patent: Aug. 18, 1987

[54] WATERBED

[75] Inventor: Nicola P. Hubert, Fischbachtal, Fed. Rep. of Germany

[73] Assignee: Halcyon Waterbed Inc., Toronto, Canada

[21] Appl. No.: 844,308

[22] Filed: Mar. 26, 1986

[30] Foreign Application Priority Data

Mar. 27, 1985 [DE] Fed. Rep. of Germany ... 8509304[U]

[51] Int. Cl.[4] ..... A47C 27/08; A47G 9/00

[52] U.S. Cl. ..... 5/451; 5/496

[58] Field of Search ..... 5/451, 449, 450, 452, 5/482, 496, 498, 460

[56] References Cited

U.S. PATENT DOCUMENTS

| | | | |
|---|---|---|---|
| 3,020,566 | 2/1962 | Anderson et al. | 5/496 |
| 3,237,564 | 12/1980 | Zeltzer | 5/451 |
| 3,840,921 | 10/1974 | LaBianco | 5/451 |
| 4,040,133 | 8/1977 | Gilreath | 5/451 |
| 4,057,862 | 11/1977 | Labianco | 5/451 |
| 4,222,139 | 9/1980 | Surdborg Recker et al. | 5/460 |
| 4,317,244 | 3/1982 | Balfour-Richie | 5/449 |
| 4,382,305 | 5/1983 | Hall et al. | 5/451 |
| 4,486,909 | 12/1984 | McKneelen | 5/451 |
| 4,494,262 | 1/1985 | Robertson | 5/496 |
| 4,506,398 | 3/1985 | Hruban | 5/451 |
| 4,549,323 | 10/1985 | Brockhaus | 5/451 |

*Primary Examiner*—Alexander Grosz

*Attorney, Agent, or Firm*—Riches, McKenzie & Herbert

[57] ABSTRACT

A waterbed is disclosed in which a waterbed mattress comprising a fluid-filled envelope is supported on a bed bottom within a recess formed by an upholstered, peripheral frame. A mattress mat has a top portion extending over the mattress with edge portions extending downward between the mattress and the frame to be secured at its lower edge to the bed bottom. With the lower edge of the mat secured to the bed bottom, tendencies of the mat to come off or be pulled up during use are eliminated.

5 Claims, 2 Drawing Figures

WATERBED

BACKGROUND OF THE INVENTION

The invention relates to a waterbed having a mattress resting upon a bed bottom within a recess formed by a peripheral upholstered frame, and having a mattress mat resting upon the said water mattress and accommodating a mat edge which is drawn down laterally.

In known waterbeds of this kind, the edge of the mattress mat is usually arranged on the outside of the upholstered frame. The bedcover, which is normally drawn over the waterbed, also engages over the upholstered frame with its edge which contains a rubber band, for example.

Deformation of the water mattress, arising when the waterbed is in use, results in inwardly directed forces, exerted upon the edge of the bedcover, pulling this edge up, causing the bedcover to crease or at least to slip partly off the upholstered frame.

Deformation, arising while the water mattress is in use, also causes the mattress mat to move, since the edge of the mat lifts at certain locations, or is drawn inwardly. The mattress mat thus also creases or may come loose at the edge.

SUMMARY OF THE INVENTION

It is therefore the purpose of the invention to design a waterbed of the type mentioned at the beginning hereof in such a manner that the mattress mat and/or the bedcover remains taut and in their original positions, even when the water mattress is deformed.

According to the invention, this purpose is accomplished in that the drawn-down mat edge is arranged between the water mattress and the upholstered frame, and is secured to the bed bottom by its lower edge.

The mat edge thus lies in the gap formed between the upholstered frame and the water mattress, the said gap normally running obliquely downwardly and inwardly. After any deformation of the water mattress, the mat reassumes its original position, since the drawn-down mat edge is secured to the bed bottom and cannot therefore be pulled up when the water mattress is deformed.

Since the drawn-down mat edge directly surrounds the water mattress, a gap is left between the inside of the upholstered frame and the drawn-down mat edge adjacent the water mattress. The edge of the bedcover can be inserted into this gap. Because of the upwardly expanding shape of the water mattress, the bedcover is adequately held, especially if the edge thereof is provided, as it usually is, with a rubber band. When the water mattress is depressed, there is no danger of the edge of the bedcover being pulled up, since the edge of the water mattress, in the vicinity of the depression is moved temporarily inwardly, instead of remaining immobile, like the upholstered frame. In this area therefore, the edge of the bedcover can carry out the same deformation as the water mattress. It then returns to its original position, as the water mattress reassumes its original shape.

According to a preferred exemplary embodiment of the invention, the mattress mat is connected to the mat edge with a detachable fastener, preferably a slide fastener. This makes it possible to detach the mattress mat from the mat edge which remains secured to the bed bottom. There is thus no need to release this attachment to the bed bottom, which is not easily accessible.

In one of its aspects, the present invention provides a waterbed having a water mattress resting upon a bed bottom within a recess formed by a peripheral upholstered frame, and having a mattress mat resting upon the water mattress and accommodating a mat edge which is drawn down laterally, characterized in that the drawn-down mat edge is arranged between the water mattress and the upholstered frame and is secured by its lower edge to the bed bottom.

In another aspect, the present invention provides a waterbed comprising a deformable fluid retaining envelope, a bottom support, an upholstered frame defining a central recess therein above the bottom support peripherally bordered by downwardly and inwardly sloping peripheral interior walls of the frame, the envelope received within the recess supported by the bottom support and the interior walls, a mattress mat having a top portion overlying the envelope and edge portions extending downwardly from the top portion between the interior walls and the envelope to lower edges of the edge portions which lower edges are coupled to the bottom support on at least two opposite sides of the envelope, with the top portion of the mat being removably coupled to the edge portions of the mat at accessible locations. Preferably the waterbed includes a removable cover having a top portion overlying the top portion of the mat with edge portions of the cover extending downwardly from the top portion of the cover between the interior walls and the edge portions of the mat. The edge portions of the cover peripherally encircle the envelope and include an elastic member biased to reduce the peripheral, circumferential extent of the edge portions of the cover to thereby securely retain the cover about the envelope.

DESCRIPTION OF THE DRAWINGS

The invention is explained hereinafter in greater detail, in conjunction with the exemplary embodiment illustrated in the accompanying drawings and in which.

DESCRIPTION OF PREFERRED EMBODIMENT

Figure 1:
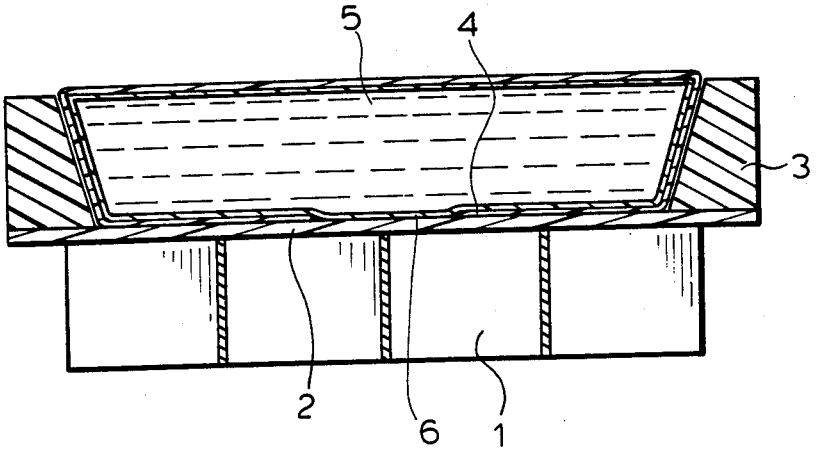
FIG. 1 shows a cross-section through a waterbed.
Figure 2:
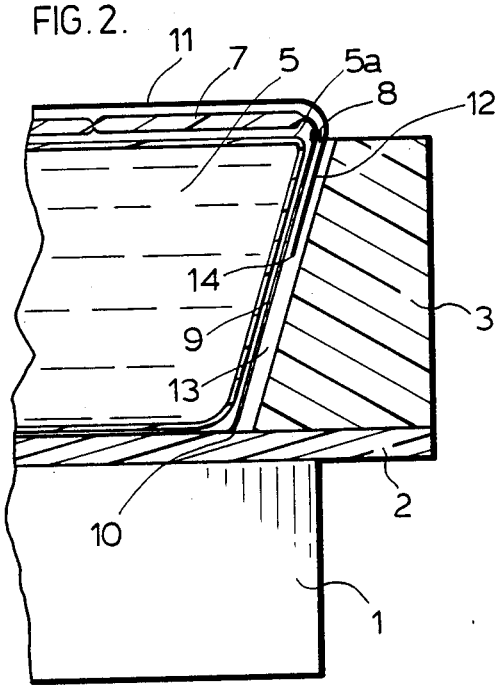
FIG. 2 is a partial cross-section, to an enlarged scale, at the edge of the waterbed according to FIG. 1.

A bed bottom 2, made out of particle-board, for example, is arranged upon a base 1 and carries, at its outer edge, a peripheral upholstered frame 3 which consists of fabric-covered foam-material and is usually wedge-shaped, i.e. the cross-section thereof tapers from bottom to top.

Bed bottom 2 and peripheral upholstered frame 3 form a box-shaped, upwardly expanding recess 4 accommodating a water mattress 5 consisting essentially of an envelope filled with water. An electrical heating pad 6 is arranged between bed bottom 2 and water mattress 5.

Water mattress 5 is largely enclosed in a safety envelope **5*a*** equipped with only one opening (not shown) in the upper surface, through which the water mattress can be inserted.

Resting upon water mattress 5 is a quilted mattress mat 7 which is secured detachably at its edge, by means of a peripheral slide fastener 8, to a drawndown mat edge 9. The lower edge 10 of mat edge 9 is secured to bed bottom 2, for example by stapling.

Water mattress 5 and mattress mat 7 are covered with a replaceable fabric bedcover 11, edge 12 of which is inserted downwardly into the oblique gap 13 between upholstered frame 4 and mat edge 9. A rubber band 14 in edge 12 of the bedcover facilitates covering of the water mattress and improves the retention and seating of bedcover 11.

While the invention has been described with reference to a preferred embodiment, it is not so limited. Many modifications and variations will now occur to those skilled in the art. For a definition of the invention, reference is made to the following claims.

What I claim is:

1. A waterbed comprising:

deformable fliud filled envelope means enclosing fluid therein, deformable fluid retaining safety liner means receiving the envelope means therein, bottom support means, resiliently deformable frame means defining a central recess therein above the bottom support means peripherally bordered by peripheral interior walls, the envelope means received within the recess supported by the bottom support means and said interior walls with the safety liner means about the envelope means sandwiched between the envelope means and bottom support means and interior walls, flexible mat means having a top portion overlying the envelope means with edge protions of the mat means extending downwardly from the top portion between said interior walls and said safety liner means, the lower edges of the edge portions coupled to the bottom support means about the periphery of the safety liner means, and the top portion of the mat means being removably couple to edge portions of the mat means at accessible locations.

2. A waterbed as claimed in claim 1 wherein said frame means comprises resilient foamed plastic.

3. A waterbed as claimed in claim 2 wherein said peripheral interior walls slope downwardly and inwardly.

4. A waterbed as claimed in claim 3 wherein said envelope means is filled with liquid.

5. A waterbed as claimed in claim 4 wherein said frame means is upholstered.

* * * * *